US008032985B2

(12) United States Patent
Seo

(10) Patent No.: US 8,032,985 B2
(45) Date of Patent: Oct. 11, 2011

(54) SUCTION BRUSH FOR VACUUM CLEANER

(75) Inventor: Ji-Ho Seo, Gwangju (KR)

(73) Assignee: Samsung Electronics Co., Ltd., Gwangju-si (KR)

( * ) Notice: Subject to any disclaimer, the term of this patent is extended or adjusted under 35 U.S.C. 154(b) by 873 days.

(21) Appl. No.: 12/008,295

(22) Filed: Jan. 10, 2008

(65) Prior Publication Data

US 2009/0019661 A1 Jan. 22, 2009

(30) Foreign Application Priority Data

Jul. 20, 2007 (KR) ..... 10-2007-0072678

(51) Int. Cl.
*A47L 9/04* (2006.01)

(52) U.S. Cl. ..... 15/364; 15/48.1; 15/41.1

(58) Field of Classification Search ..... 15/364, 15/388, 384, 48.1, 27, 41.1, 52.1, 98, 383, 15/389, 377
See application file for complete search history.

(56) References Cited

U.S. PATENT DOCUMENTS

| | | | | |
|---|---|---|---|---|
| 1,336,760 | A | 4/1920 | Stewart | |
| 6,918,156 | B2 * | 7/2005 | Joo et al. | 15/388 |
| 2007/0143954 | A1 | 6/2007 | Graham et al. | |

FOREIGN PATENT DOCUMENTS

| | | |
|---|---|---|
| DE | 2428400 | 1/1976 |
| DE | 2556335 | 7/1976 |
| EP | 0302515 | 2/1989 |
| GB | 2386055 | 9/2003 |
| JP | 2006340848 | 12/2006 |
| KR | 100165065 | 9/1998 |
| KR | 100170848 | 10/1998 |

OTHER PUBLICATIONS

Extended European Search Report for corresponding European Patent Application No. 08103951.3 dated Jul. 31, 2009.

* cited by examiner

*Primary Examiner* — Dung Van Nguyen
(74) *Attorney, Agent, or Firm* — Ohlandt, Greeley, Ruggiero & Perle, LLP

(57) ABSTRACT

A suction brush for a vacuum cleaner is provided. The suction brush a vacuum cleaner includes a brush main body connected to a cleaner main body and having a dust suction port provided on a bottom surface of the brush main body, first and second wheels rotatably engaged with both sides of the brush main body, and at least one hair removing unit, arranged in front of the suction port of the brush main body, for receiving rotation drive forces from the first and second wheels and raking up hair existing on a surface to be cleaned toward the dust suction port.

11 Claims, 4 Drawing Sheets

SUCTION BRUSH FOR VACUUM CLEANER

CROSS-REFERENCE TO RELATED APPLICATIONS

This application claims the benefit under 35 U.S.C. §119 of Korean Patent Application No. 2007-72678, filed 20 Jul. 2007 in the Korean Intellectual Property Office, the entire disclosure of which is incorporated herein by reference.

BACKGROUND OF THE INVENTION

1. Field of the Invention

The present disclosure relates generally to a suction brush for a vacuum cleaner. More particularly, the present disclosure relates to a suction brush for a vacuum cleaner which facilitates the removal of hair or animal fur that is deeply stuck in a carpet and the like.

2. Description of the Related Art

Generally, a vacuum cleaner is composed of a cleaner main body and a suction brush, which is separably connected to the main body through a connection tube and a flexible hose, or is directly hinge-engaged with the main body. This suction brush sucks in dust and other foreign materials using a suction force generated by a suction motor installed in the main body as it moves on a surface to be cleaned.

A conventional suction brush for a vacuum cleaner secures a power source from a turbine installed in a suction flow path provided in a brush main body. Air being sucked through the suction flow path at high speed results in the rotation of the turbine. The driving force of the turbine is transferred to a rotating brush that is arranged in a dust suction port provided on a bottom surface of the brush main body, and the rotating brush cleans the surface to be cleaned. In this case, however, since the turbine is arranged on the suction flow path, it disturbs the flow of the sucked air, and thus the suction force in the suction brush is lowered.

On the other hand, Korean Patent Publication No. 165065 discloses a suction brush which drives duster plates up and down so that the duster plates beat a surface to be cleaned as wheels installed in a brush main body rotate without employing a rotary drum and a turbine. Through this suction brush structure, however, it is not easy to remove hair or pet fur stuck in a carpet.

In addition, Korean Patent Publication No. 170848 discloses a structure in which a drive fan that is rotated by air being sucked through a dust suction port of a suction brush is installed on a bottom surface of the suction brush, and a brush fixture combined with a brush member goes and returns in a direction perpendicular to a brush forwarding direction, by a rotating force of the drive fan. Although this structure is advantageous in removing foreign materials inserted in mat textures, it is improper for raking up hair stuck in a carpet and moving the raked hair toward a suction port.

SUMMARY OF THE INVENTION

Embodiments of the present disclosure have been developed in order to substantially solve the above and other problems associated with the conventional arrangement and provide the objectives listed below. An aspect of embodiments of the present disclosure is to provide a suction brush for a vacuum cleaner that can remove hair or animal fur that is stuck on a surface to be cleaned with the deterioration of a suction force in the suction brush prevented.

The foregoing and other objects and advantages are substantially realized by providing a suction brush for a vacuum cleaner, according to embodiments of the present disclosure, which comprises a brush main body connected to a cleaner main body and having a dust suction port provided on a bottom surface of the brush main body; first and second wheels rotatably engaged with both sides of the brush main body; and at least one hair removing unit, arranged in front of the suction port of the brush main body, for receiving rotation drive forces from the first and second wheels and raking up hair existing on a surface to be cleaned toward the dust suction port. Rotation drive forces can be transmitted from either or both of the first and second wheels to the hair removing unit by way of, for example, a geared drive train of which the first wheel, the second wheel, or both wheels, and the hair removing unit are parts.

The hair removing unit may comprise a cam member, rotatably installed in the brush main body, for receiving a drive force generated by rotation of the first or second wheel; a movable member for moving forward and backward with respect to a moving direction of the brush main body in accordance with a rotation of the cam member; and a rib, coupled to a lower part of a front end of the movable member, for raking up the hair on the surface to be cleaned. The cam member could, for example, be mechanically coupled to a geared drivetrain of which the first wheel, the second wheel, or both wheels are parts. In such a mechanical coupling a drive force applied to the first and/or second wheel is transmitted via the geared drivetrain to the cam member, thereby effecting movement of the cam member.

The movable member may comprise a cam contact unit, arranged to be in elastic contact with the cam member, for going and returning (that is, moving forward and backward with respect to a moving direction of the brush main body) in accordance with the rotation of the cam member; and a rib support unit for supporting the rib, the rib support unit being coupled to the cam contact unit for driving the rib in the same direction as a driving direction of the cam contact unit. The elastic contact of cam contact unit and cam member could be provided by, for example, various elastic members (springs, elastomer members), or even pneumatically.

In this case, the rib support unit may be arranged along a front portion of the brush main body, and the rib may have a length that corresponds to the rib support unit. Also, the rib support unit may be exposed to an outside of the brush main body. A center of the rib support unit may coincide with a rotation center of the cam member, so that a force applied from the cam member is uniformly transferred to the rib support unit.

The rib may be formed to be rounded toward the suction port as it gets from its upper end to its lower end, or may be formed to be inclined toward the suction port as it gets from its upper end to its lower end, so that resistance between the rib and the surface to be cleaned is minimized when the rib support unit moves forward, while the hair is effectively raked up toward the suction port when the rib support unit moves backward.

BRIEF DESCRIPTION OF THE DRAWINGS

The above aspects and features of embodiments of the present disclosure will become more apparent by describing certain exemplary embodiments of the present disclosure with reference to the accompanying drawings, in which.

Throughout the drawings, like reference numerals will be understood to refer to like parts, components and structures.

DETAILED DESCRIPTION OF EXEMPLARY EMBODIMENTS

Exemplary embodiments of the present disclosure will now be described in detail with reference to the annexed drawings. In the following description, detailed descriptions of known functions and configurations incorporated herein have been omitted for conciseness and clarity.

Figure 1:
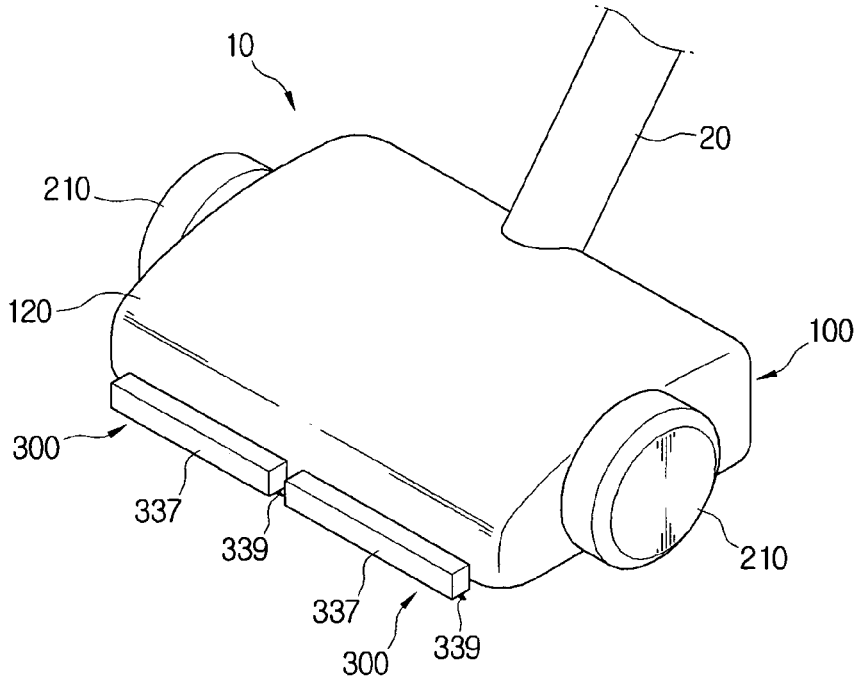
FIG. 1 is a perspective view of a suction brush for a vacuum cleaner according to an embodiment of the present disclosure.
Figure 2:
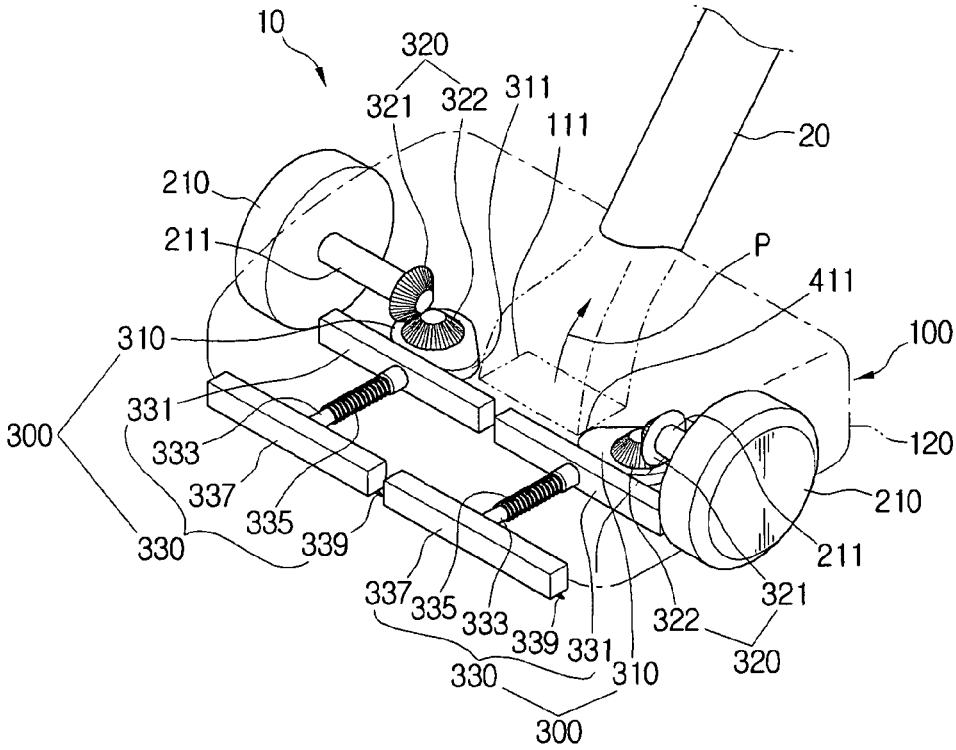
FIG. 2 is a projective view illustrating an inside of a suction brush illustrated in FIG. 1.

Referring to FIGS. 1 and 2, a suction brush 10 according to an embodiment of the present disclosure includes a brush main body 100, first and second wheels 210 and 220, and first and second hair removing units 300.

Figure 3:
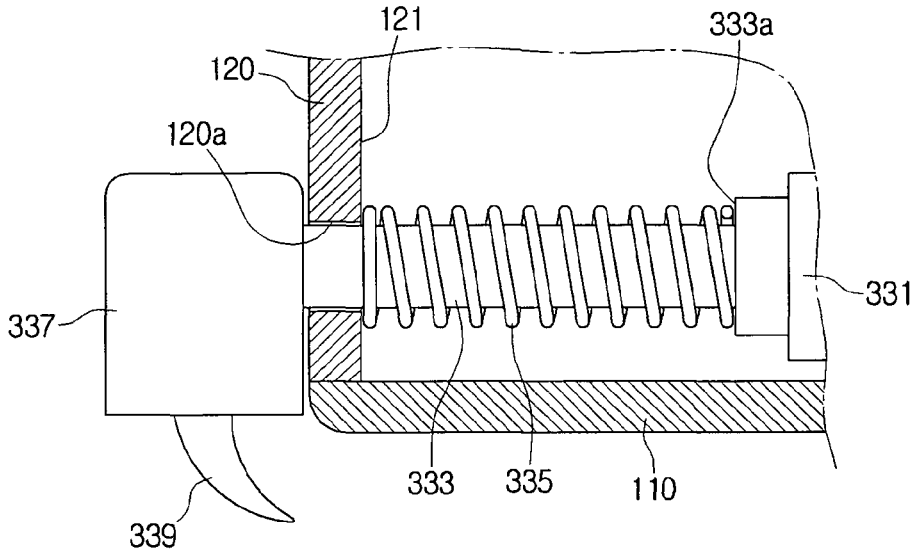
FIG. 3 is a partially enlarged view of a front end part of a first hair removing unit illustrated in FIG. 2.

The brush main body 100 is provided with an upper housing 120 and a lower housing 110 (see FIG. 3). The lower housing 110 has a dust suction port 111, formed on a bottom surface thereof, for sucking in dust, and the upper housing 120, which is coupled to the lower housing 10, is connected to one end of an extension tube 20 the other end of which is connected to a cleaner main body (not illustrated) of a vacuum cleaner. In this case, the brush main body 100 has a suction flow path P, formed from the suction port 111 to the extension tube 20 in the brush main body 100, for passing therethrough sucked air, dust, and other dirt particles.

In an embodiment of the present disclosure, it is exemplified that the suction brush 10, which is connected to the cleaner main body through the extension tube 20, is applied to a canister type vacuum cleaner. However, the application of the suction brush 10 according to the present disclosure is not limited to a canister type vacuum cleaner, but is also compatible with an upright type vacuum cleaner.

The first and second wheels 210 are rotatably coupled to both sides of the brush main body 100 through wheel shafts 211.

The first and second hair removing units 300 are symmetrically arranged on the brush main body 100. Parts of the first and second removing units 300 are arranged adjacent to the wheel shafts 211 in the brush main body 100, and the remaining parts thereof are exposed to an outside of the brush main body 100. In this case, it is also possible to extend a front portion of the upper housing 120 of the brush main body 100 so that the extended front portion completely conceals the first and second hair removing units 300.

The first hair removing unit 300 comprises a first cam member 310 and a first movable member 330. The first cam member 310 is rotatably arranged in the lower housing 110 (See FIG. 3) so that its rotation center coincides with a wheel shaft 211. The first cam member 310 has a projection portion 311 formed on one side of its outer periphery. The first cam member 310 receives a drive force generated when the first wheel 210 is rotated by a bevel gear unit 320. In this case, the bevel gear unit 320 comprises a first bevel gear 321 formed at one end of the wheel shaft 211, and a second bevel gear 322 arranged at a right angle to a shaft direction of the first bevel gear 321. Accordingly, the first cam member 310 receives a rotation drive force of the first wheel 210 that is rotated when the suction brush 10 moves forward and backward on the surface to be cleaned, and is rotated in one direction or in an opposite direction.

The first movable member 330 comprises a cam contact unit 331, a connection unit 333, a return spring 335, a rib support unit 337, and a rib 339.

The cam contact unit 331 is arranged adjacent to the first cam member 310 of the lower housing 110 so as to be in contact with the first cam member 310. As illustrated in FIG. 3, the cam contact unit 331 is elastically moved in a forward or backward direction along the moving direction of the suction brush 10, by the return spring 335 installed in the connection unit 333, when the first cam member 310 is rotated.

The connection unit 333 connects the can contact unit 331 to the rib support unit 337, and transfers the driving force of the cam contact unit 331 to the rib support unit 337 arranged outside the brush main body 100. In an embodiment of the present disclosure, both ends of the connection unit 333 are connected to centers of the cam contact unit 331 and the rib support unit 337 so that the drive force of the can contact unit 331 is uniformly transferred to the rib support unit 337 through the connection unit 333. On the other hand, it is also possible that plural connection units 333 are provided to connect the cam contact unit 331 to the rib support unit 337. Upper housing 120 provides a hole 120*a*, through which connection unit 333 is passed.

In a state that the return spring 335 is coupled to the connection unit 333, an end of the return spring 335 is supported by a front side wall 121 of the upper housing 120, and another end of return spring 335 is supported by a stepped portion 333*a* of the connection unit 333. Accordingly, the return spring 335 elastically supports the cam contact unit 331 in a backward direction of the suction brush 10.

The rib support unit 337 is formed with a specified length along the front portion of the brush main body 100, and at the lower end of the rib support unit 337 is coupled the rib 339 for raking up hair or pet fur that is stuck in a surface to be cleaned, for example, a carpet.

The rib 339 is formed to extend to a position that is lower than the bottom surface of the brush main body 100, and as illustrated in FIG. 3, the rib 339 is formed to be rounded toward the suction port 111 as it gets from its upper end (proximal to rib support unit 337) to its lower end (distal to rib support unit 337), so that the resistance between the rib 339 and the surface to be cleaned is minimized when the rib support unit 337 moves forward, while the hair or pet fur stuck in the carpet is effectively raked up toward the suction port 111 when the rib support unit 337 moves backward. However, the shape of the rib 339 is not limited thereto, and it is also possible that the rib is formed to be slanted in a straight line toward the suction port 111 as it gets from its upper end to its lower end.

In addition, it is preferable that the rib 339 is made of a soft material so that it does not damage the carpet.

In an embodiment of the present disclosure, it is exemplified that the first and second hair removing units 300 are provided as a pair of hair removing units, but are not limited thereto. It is also possible that a single hair removing unit is provided to be driven by the rotation drive force from either of the first and second wheels 210. In the case where a single hair removing unit is provided, it is preferable that the rib support unit 337 be formed to have a length corresponding to the whole front portion of the brush main body 100, and the cam contact unit 331 having a length corresponding to the length of the rib support unit 337 is connected to the rib support unit 337.

The operation of the suction brush for a vacuum cleaner as constructed above according to an embodiment of the present disclosure will now be described with reference to the accompanying drawings.

When a user cleans a surface to be cleaned, for example, a carpet (not illustrated), he/she moves the suction brush 10 forward and backward on the carpet. In this case, as illustrated in FIG. 1, the first and second wheels 210 are rotated in one direction or in an opposite direction, by the movement of the suction brush 10, and transfer their respective drive forces to the first and second cam members 310 of the first and second hair removing unit 300.

Accordingly, the first and second cam members 310 drive the first and second movable members 330 as they rotate in one direction and in an opposite direction.

Since the first and second hair removing units perform the same operation, only the operation of the first hair removing unit 300 will be described with reference to FIGS. 4 to 7.

Figure 4:
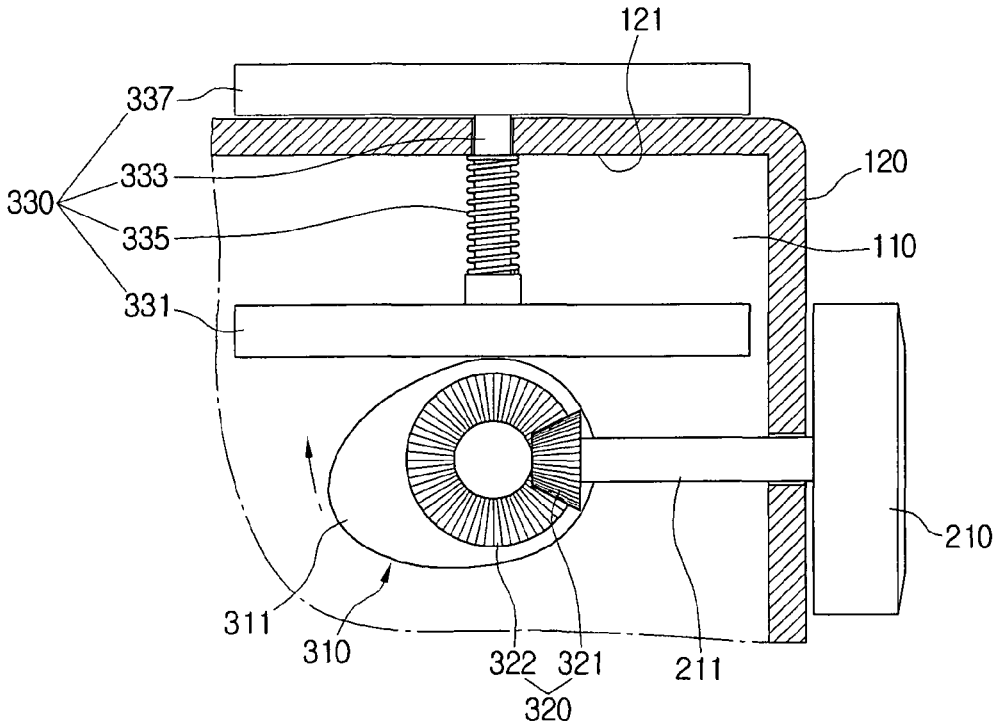
FIGS. 4 to 7 are schematic views successively illustrating a process of operating a first movable member that is performed by a first cam member interlocking with a wheel.
Figure 5:
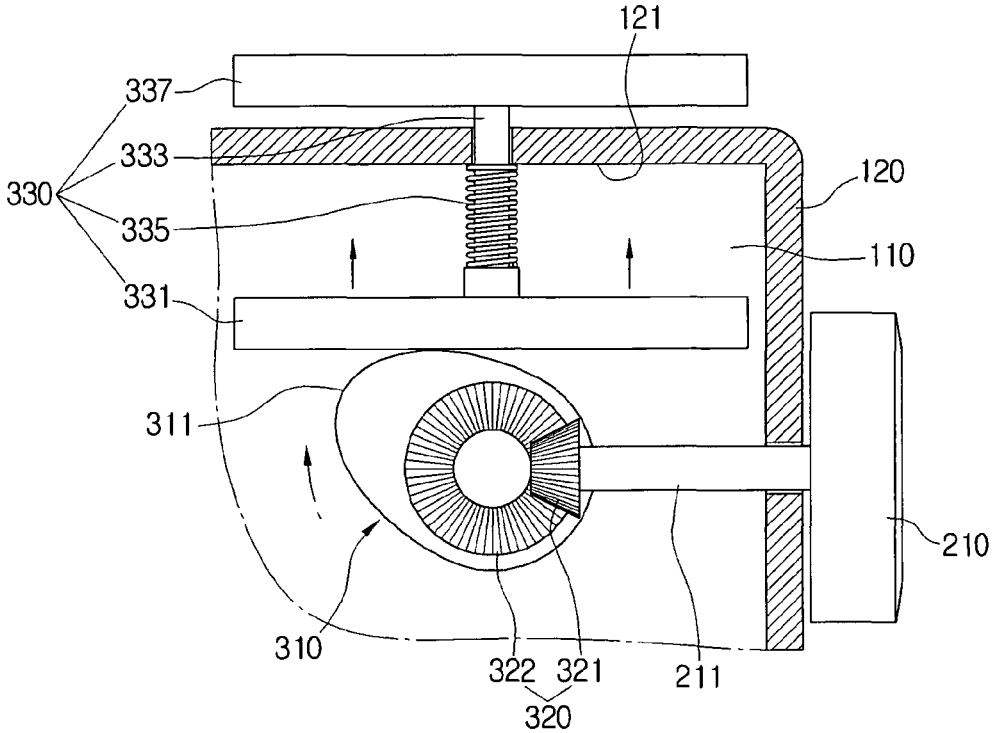

If the cam contact unit 331 of the first hair removing unit 300 is rotated clockwise as shown in FIG. 5 in a state that the cam contact unit 331 is in contact with a portion that is not the projection portion 311 as shown in FIG. 4, the projection portion 311 of the first cam member 310 pushes the can contact unit 331 of the first movable member 330, and the rib support unit 337 of the first movable member 330 moves in a forward moving direction of the suction brush 10 to make the rib 339 move forward.

Figure 6:
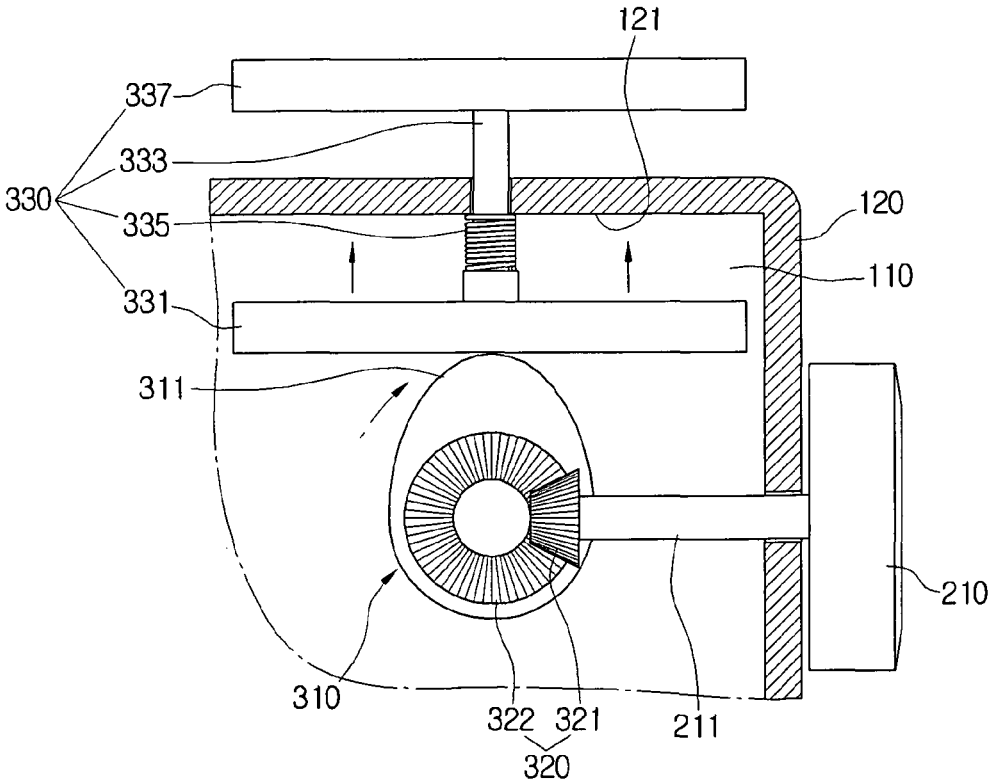
Figure 7:
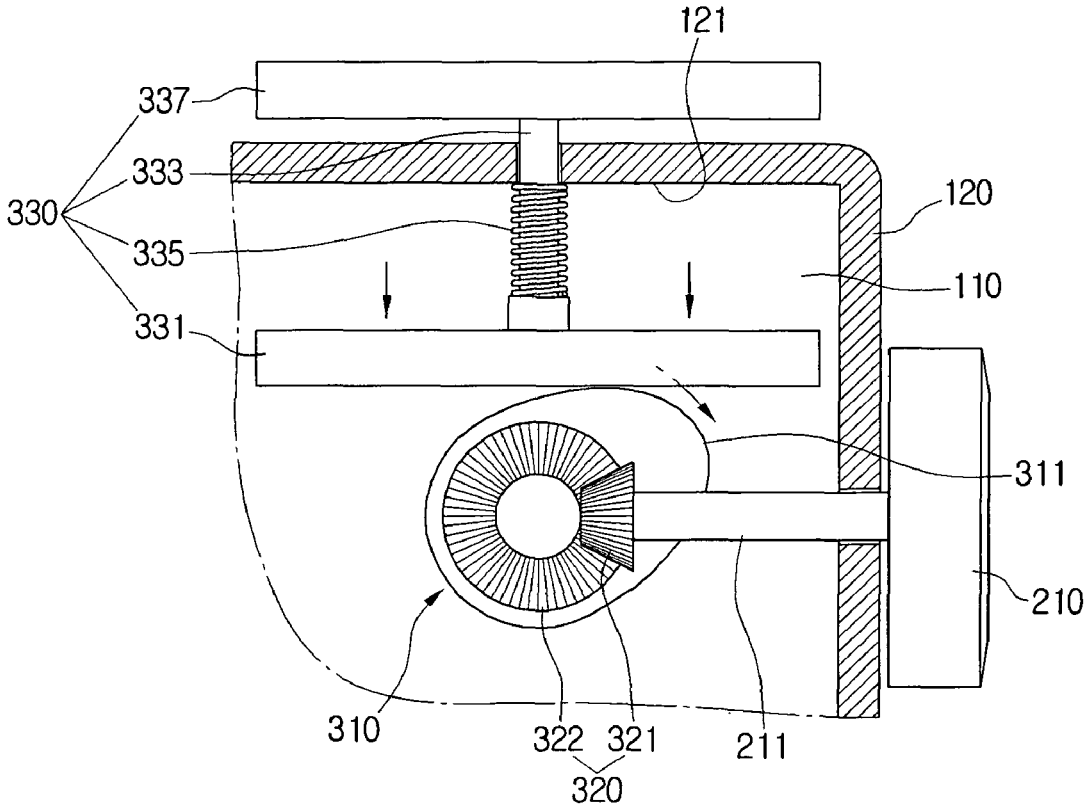

In succession, if the cam contact unit 331 comes in contact with the front end of the projection portion 311 of the first cam member 310 as shown in FIG. 6, and then the projection portion 311 of the first cam member 310 becomes adjacent to the first wheel 210 as shown in FIG. 7, as the first cam member 310 is rotated clockwise, the rib support unit 337 moves backward by the return spring 335 to make the rib 339 move back to the suction port 111.

Accordingly, the rib 339, which moves backward (i.e. toward suction port 111), rakes up the hair or pet fur that is deeply stuck in the carpet toward the suction port 111. In this case, since no structure that lowers the suction force, such as the conventional turbine, exists in a suction flow path P of the suction brush 10, the suction brush 10 sucks in the hair or pet fur raked up toward the suction port 111 by the rib 339 with a high suction force, and thus the cleaning efficiency can be maximized.

On the other hand, as the first and second cam members 310 make the first and second movable members 330 move forward and backward as they rotate clockwise and counter-clockwise as described above, the hair or pet fur stuck in the carpet can be effectively removed through the ribs 339 and 439.

As described above, according to the present disclosure, since the hair removing units are driven by the driving forces of the wheels without an obstacle such as a conventional turbine in the suction flow path, the hair existing on the surface to be cleaned can be effectively removed with the deterioration of the suction force in the suction brush prevented, and thus the cleaning efficiency can be increased.

The foregoing embodiments and advantages are merely exemplary and are not to be construed as limiting the present disclosure. The present teaching can be readily applied to other types of apparatus. Also, the description of the embodiments of the present disclosure is intended to be illustrative, and not to limit the scope of the claims, and many alternatives, modifications, and variations will be apparent to those skilled in the art.

What is claimed is:

1. A suction brush for a vacuum cleaner, comprising:

a brush main body connected to a cleaner main body and having a first side, a second side, and a bottom surface, and having a dust suction port provided on the bottom surface of the brush main body;

a first wheel rotatably engaged with the first side of the brush main body;

a second wheel rotatably engaged with the second side of the brush main body; and at least one hair removing unit, arranged in front of the dust suction port, receiving rotation drive forces from the first and second wheels and raking up hair existing on a surface to be cleaned toward the dust suction port, wherein the hair removing unit has a part that is exposed in front of the brush main body, the part moving forward and backward in a moving direction of the brush main body.

2. The suction brush of claim 1, wherein the hair removing unit comprises:

a cam member, rotatably installed in the brush main body, receiving the rotation drive force of the first or second wheels;

a movable member for moving forward and backward with respect to a moving direction of the brush main body in accordance with a rotation of the cam member; and a rib, having an upper end and a lower end, the upper end coupled to a lower part of a front end of the movable member, the lower end raking up the hair on the surface to be cleaned.

3. The suction brush of claim 2, wherein the movable member comprises:

a cam contact unit, arranged to be in elastic contact with the cam member, for going and returning in accordance with the rotation of the cam member; and a rib support unit for supporting the rib, the rib support unit being coupled to the cam contact unit for driving the rib in the same direction as a driving direction of the cam contact unit.

4. The suction brush of claim 3, wherein the rib support unit is arranged along a front portion of the brush main body, and the rib has a length that corresponds to the rib support unit.

5. The suction brush of claim 3, wherein the rib support unit is exposed to an outside of the brush main body.

6. The suction brush of claim 3, wherein the rib support unit has a center that coincides with a rotation center of the cam member.

7. The suction brush of claim 2, wherein the lower end of the rib is rounded toward the suction port.

8. The suction brush of claim 2, wherein the lower end of the rib is inclined toward the suction port.

9. A suction brush for a vacuum cleaner, comprising:

a brush main body connected to a cleaner main body and having a first side, a second side, and a bottom surface, and having a dust suction port provided on the bottom surface of the brush main body;

a first wheel rotatably engaged with the first side of the brush main body;;

a second wheel rotatably engaged with the second side of the brush main body; and first and second hair removing units, arranged in front of the suction port, for receiving rotation drive forces from the first and second wheels and raking up hair existing on a surface to be cleaned toward the dust suction port, wherein the hair removing unit has a part that is exposed in front of the brush main body, the part moving forward and backward in a moving direction of the brush main body.

10. The suction brush of claim 9, wherein the first hair removing unit comprises a first cam member, installed adjacent to the first wheel in the brush main body, for rotating by a drive force of the first wheel; a first movable member, elastically arranged in the brush main body, for moving forward and backward with respect to a moving direction of the brush main body in accordance with a rotation of the first cam member; and a first rib, coupled to a lower part of a front end of the movable member, for raking up the hair on the surface to be cleaned; and wherein the second hair removing unit comprises a second cam member, installed adjacent to the second wheel in the brush main body, for rotating by a drive force of the second wheel; a second movable member, elastically arranged in the brush main body, for moving forward and backward with respect to a moving direction of the brush main body in accordance with a rotation of the second cam member; and a second rib, coupled to the lower part of the front end of the movable member, for raking up the hair on the surface to be cleaned.

11. A suction brush for a vacuum cleaner, comprising:

a brush main body connected to a cleaner main body and having a first side, a second side, and a bottom surface, and having a dust suction port provided on the bottom surface of the brush main body;

a first wheel rotatably engaged with the first side of the brush main body;

a second wheel rotatably engaged with the first second side of the brush main body; and at least one hair removing unit, installed in the brush main body, for moving forward and backward in a moving direction of the brush main body that moves on a surface to be cleaned by rotation drive forces of the first and second wheels;

wherein the hair removing unit has a part that is exposed in front of the brush main body, and a lower end of the part of the hair removing unit extends to a position that is lower than the bottom surface of the brush main body to rake up hair stuck on the surface to be cleaned.

* * * * *